US010163558B2

(12) United States Patent
Vanukuru

(10) Patent No.: US 10,163,558 B2
(45) Date of Patent: Dec. 25, 2018

(54) VERTICALLY STACKED INDUCTORS AND TRANSFORMERS

(71) Applicant: GLOBALFOUNDRIES INC., Grand Cayman (KY)

(72) Inventor: Venkata Narayana Rao Vanukuru, Bangalore (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 0 days.

(21) Appl. No.: 15/003,532

(22) Filed: Jan. 21, 2016

(65) Prior Publication Data

US 2017/0213637 A1 Jul. 27, 2017

(51) Int. Cl.

| | |
|---|---|
| ***H01F 27/28*** | (2006.01) |
| ***H01F 5/00*** | (2006.01) |
| ***H01F 17/00*** | (2006.01) |

(52) U.S. Cl.

CPC ..... *H01F 27/2804* (2013.01); *H01F 17/0013* (2013.01); *H01F 2017/0066* (2013.01); *H01F 2027/2809* (2013.01)

(58) Field of Classification Search

CPC .. H01F 27/28; H01F 27/2804; H01F 17/0006; H01F 17/0013; H01F 41/06; H01F 27/2823; H01F 2017/0066; H01F 2027/2809

USPC ..... 336/220, 200, 223, 170; 29/605

See application file for complete search history.

(56) References Cited

U.S. PATENT DOCUMENTS

| | | | | |
|---|---|---|---|---|
| 8,896,094 | B2 | 11/2014 | Yen et al. | |
| 9,171,663 | B2 | 10/2015 | Barry et al. | |
| 2006/0028313 | A1* | 2/2006 | Strzalkowski | H01F 27/2804 336/223 |
| 2008/0284553 | A1* | 11/2008 | Lim | H01F 27/006 336/200 |
| 2010/0052839 | A1* | 3/2010 | Mertens | H01L 23/48 336/232 |
| 2011/0133879 | A1* | 6/2011 | Chiu | H01F 17/0013 336/200 |
| 2012/0133471 | A1 | 5/2012 | Jin et al. | |
| 2012/0188047 | A1* | 7/2012 | Groves | H01F 17/0013 336/200 |
| 2013/0200981 | A1* | 8/2013 | Park | H01F 27/2852 336/200 |
| 2016/0163451 | A1* | 6/2016 | Wang | H01F 41/042 336/192 |

OTHER PUBLICATIONS

Vanukuru et al., "High Density Solenoidal Series Pair Symmetric Inductors and Transformers", IEEE Transactions on Electron Devices vol. 61, No. 7, Jul. 2014, pp. 2503-2508.

(Continued)

*Primary Examiner* — Mang Tin Bik Lian

(74) *Attorney, Agent, or Firm* — Anthony Canale; Andrew M. Calderon; Roberts Mlotkowski Safran Cole & Calderon, P.C.

(57) ABSTRACT

The present disclosure relates generally to semiconductor structures, and more particularly, to structures and methods for implementing high performance vertically stacked inductors and transformers. The structure includes: a first conductor composed of a redistribution line; a second conductor composed of a back end of line wiring layer, coupled to the redistribution line; and a ferro magnetic material between the first conductor and the second conductor.

15 Claims, 2 Drawing Sheets

(56) References Cited

OTHER PUBLICATIONS

Durand, "High Performance RF Inductors Integrated in Advanced Fan-Out Wafer Level Packaging Technology", IEEE 2012, pp. 215-218.
Zolfaghari et al., "Stacked Inductors and Transformers in CMOS Technology", IEEE Journal of Solid-State Circuits, vol. 36, No. 4, Apr. 2001, pp. 620-628.

* cited by examiner

VERTICALLY STACKED INDUCTORS AND TRANSFORMERS

FIELD OF THE DISCLOSURE

The present disclosure relates generally to semiconductor structures, and more particularly, to structures and methods for implementing high performance vertically stacked inductors and transformers.

BACKGROUND

An inductor is an important component for an electric circuit with a resistor, a capacitor, a transistor and a power source. The inductor has a coil structure where a conductor is wound many times as a screw or spiral form, as an example. The inductor suppresses a rapid change of a current by inducing voltage in proportion to an amount of a current change. A ratio of counter electromotive force generated due to electromagnetic induction according to the change of the current flowing in a circuit is called an inductance (L).

Generally, the inductor is used in an Integrated Circuit (IC) for communication systems including high performance RF filters, and distributed amplifiers. In particular, inductors are used in a packaging technology for integrating many elements to a single chip, known as a System on Chip (SoC). Accordingly, an inductor having a micro-structure and good electrical characteristics is needed.

A transformer is an electrical device that transfers electrical energy between two or more circuits through electromagnetic induction. Commonly, transformers are used to increase or decrease the voltages of alternating current in electric power applications. For example, in operation, a varying current in the transformer's primary winding creates a varying magnetic flux in the transformer core and a varying magnetic field impinging on the transformer's secondary winding. This varying magnetic field at the secondary winding induces a varying electromotive force (EMF) or voltage in the secondary winding due to electromagnetic induction. However, very high turns ratio transformers are planar with limited coupling with a large area footprint, which increases manufacturing costs. In addition, existing high turns ratio transformers have reduced current handling capability.

SUMMARY

In an aspect of the disclosure, a structure includes: a first conductor composed of a redistribution line; a second conductor composed of a back end of line wiring layer, coupled to the redistribution line; and a ferro magnetic material between the first conductor and the second conductor.

In an aspect of the disclosure, a structure includes: a vertically stacked primary winding comprising a first conductor composed of a redistribution line and a second conductor composed of a back end of line wiring layer, coupled to the redistribution line; and a vertically stacked secondary winding coupled to the vertically stacked primary winding and comprising the back end of line wiring layer and a lower back end of the line wiring stacked underneath the back end of the line wiring layer.

In an aspect of the disclosure, a method includes: forming a first conductor composed of a redistribution line; forming a second conductor composed of a back end of line wiring layer, coupled to the redistribution line; and forming a ferro magnetic material between the first conductor and the second conductor.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

Figure 1:
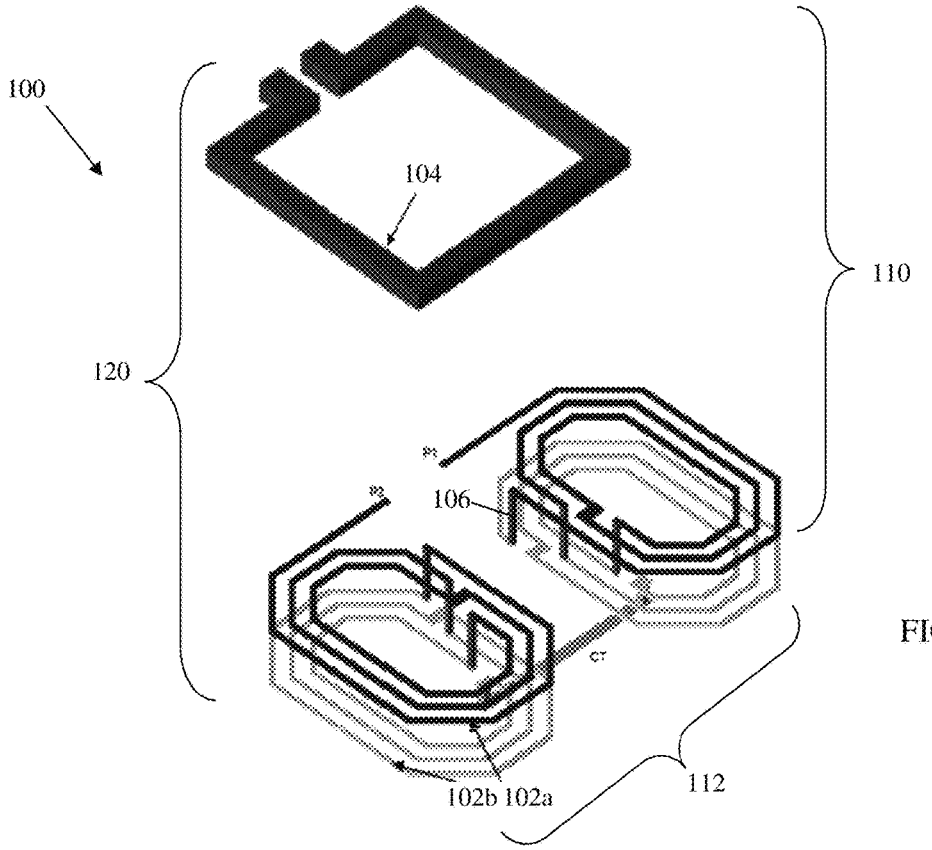
FIG. 1 is an exploded view of a vertically stacked inductor and transformer in accordance with aspects of the disclosure.

The present disclosure relates generally to semiconductor structures, and more particularly, to structures and methods for implementing high performance vertically stacked inductors and transformers. More specifically, the present disclosure is directed to a vertically stacked inductor with high inductance density, and a highly efficient vertically stacked transformer with high turns ratio and excellent (e.g., high) current handling. Advantageously, the vertically stacked inductor and transformer disclosed herein are fabricated using a combination of a redistribution layer (RDL) and back end of the line (BEOL) layers.

In embodiments, the vertically stacked inductors and transformers are symmetric three dimensional (3D) structures. Moreover, the vertically stacked transformer has high turns ratio (e.g., impedance transformation ratio) with improved coupling and current handling capability. In more specific embodiments, the vertically stacked transformer has high gain and lower insertion loss, compared to conventional planar transformers. In this way, the vertically stacked transformer can be used to improve the performance of on-chip power amplifiers.

On the other hand, the 3D symmetric inductor structure has high inductance density, high Quality (Q) factor and a high self resonant frequency. In order to accomplish these advantages, the vertically stacked inductor structure can include a magnetic material between the BEOL layer and the RDL.

The vertically stacked inductor and transformer are also compatible with CMOS processes. In embodiments, the vertically stacked inductor and transformer can be composed of multiple spirals of wiring structures (conductors). For example, and without limitations, the following design rules can be utilized:

(i) The total width or the diameter of the spiral turns may be reduced at a constant rate or any other monotonic rate (including periodically constant) as the radius is reduced toward the center of the coil;

(ii) The space between each consecutive spiral turn may be increased at a constant rate or any other monotonic rate (including periodically constant) as the radius is reduced toward the center of the coil;

(iii) The width or diameter of each spiral segment may be reduced at a constant rate or any other monotonic rate (including periodically constant) as the radius is reduced toward the center of the coil;

(iv) The space between segments in upper and adjacent lower spiral turns may be increased at a constant rate or any other monotonic rate (including periodically constant) as the radius is reduced toward the center of the coil;

(v) The width of the upper spiral can be made significantly different from the adjacent lower spiral without disturbing the overall inductor structure;

(vi) The width and spacing of the upper and adjacent lower spirals turns can be different without altering the device structure;

(vii) The upper and adjacent lower spirals can have a slight offset instead of being perfectly aligned vertically to each other;

(viii) The spacing between segments within a turn can be increased while the total turn width can be decreased, maintaining a constant low frequency inductance and resistance, to further enhance high frequency performance; and/or (ix) More than one vertically adjacent metal layer can be connected in parallel to realize any of the upper or lower spirals to decrease series resistance.

The vertically stacked inductors and transformers of the present disclosure can be manufactured in a number of ways using a number of different tools. In general, though, the methodologies and tools are used to form structures with dimensions in the micrometer and nanometer scale. The methodologies, i.e., technologies, employed to manufacture the symmetric multi-port inductors have been adopted from integrated circuit (IC) technology. For example, the structures of the present disclosure are built on wafers and are realized in films of material patterned by photolithographic processes on the top of a wafer. In particular, the fabrication of the symmetric multi-port inductors uses three basic building blocks: (i) deposition of thin films of material on a substrate, (ii) applying a patterned mask on top of the films by photolithographic imaging, and (iii) etching the films selectively to the mask. In addition, the upper most coil can be composed of a redistribution layer (RDL), which can be formed using different processes such as, for example, soldering, adhesion or bonding of a metal layer, deposition and etching processes, etc.

FIG. 1 is an exploded view of a vertically stacked inductor and transformer in accordance with aspects of the disclosure. More specifically, the structure 100 includes a vertically stacked inductor 110 composed of a BEOL layer 102*a* and an upper redistribution layer 104. The BEOL layer 102*a* comprises ports P1, P2 which may be used as a contact point for the structure.

As should be understood by those of skill in the art, the RDL 104 is an extra metal layer on a top surface of the structure 100 that makes the IO pads of an integrated circuit available in other locations. As should further be understood by those of skill in the art, the RDL 104 does not have the same processing constraints as the BEOL layer 102*a*. In fact, the constraints placed on the RDL 104 are known to be significantly less stringent compared to the BEOL layer 102*a*. For example, the RDL 104 can have a thickness of about 6 μm to 7 μm compared to the thickness of the BEOL layer 102*a* of about 3 μm to about 5 μm; although other dimensions are contemplated herein depending on the design parameters of the vertically stacked inductor 110. The spacing between the windings of the BEOL layer 102*a* can be about 2 μm to about 5 μm; although other dimensions are also contemplated by the present disclosure.

Figure 2:
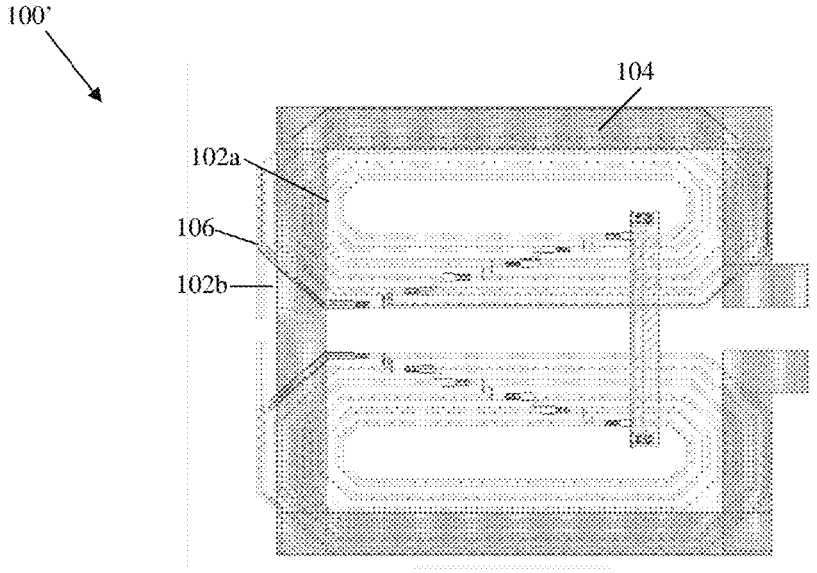
FIG. 2 is a layout view showing a vertically stacked inductor and transformer in accordance with aspects of the disclosure.
Figure 3:
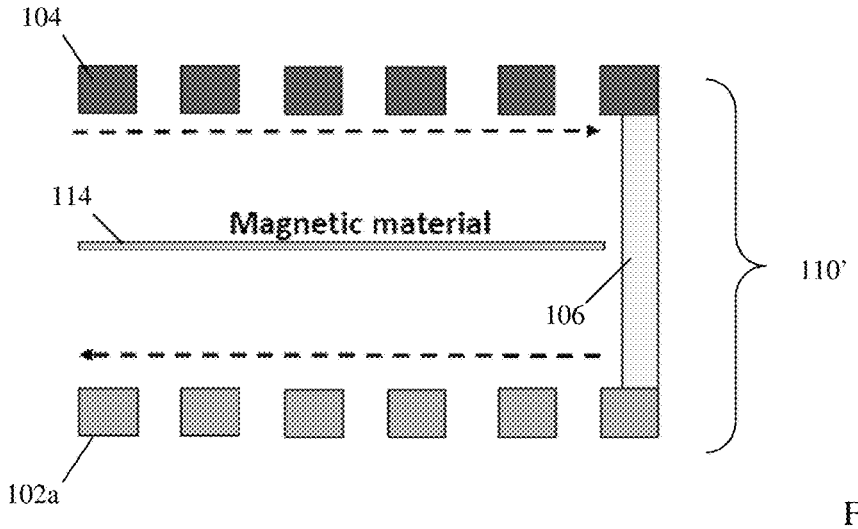
FIG. 3 is a cross-section view of an inductor structure in accordance with aspects of the present disclosure.
Figure 4:
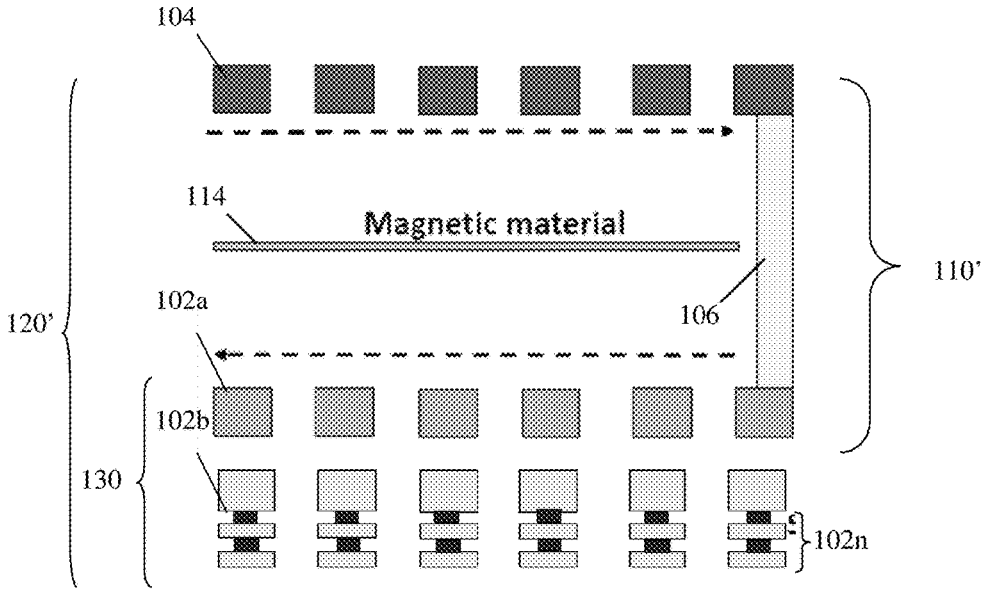
FIG. 4 is a cross-section view of a vertically stacked inductor and transformer in accordance with aspects of the disclosure.

In embodiments, the RDL 104 is shown as a single winding, however, one of skill in the art would understand that the RDL 104 can be multiple windings having the same pitch or different pitch than the underlying BEOL layer 102*a* (as shown in FIGS. 2-4). In embodiments, the RDL 104 can also have different dimensions, e.g., width, height and shape, than the BEOL layer 102*a* or any combinations thereof. In further embodiments, the design rules (i)-(ix) for the wiring layers (conductors) can be implemented with this and any of the embodiments described herein. For example, the spacing between the windings of the BEOL layer 102*b* can be about 2 μm to about 5 μm; although other dimensions are also contemplated by the present disclosure.

In embodiments, the RDL 104 can be a metal material, e.g., copper, manufactured in a number of inexpensive ways (compared to the BEOL layer 102*a*). For example, the RDL 104 can be solder or an adhesion or bonding of a metal layer to the upper surface of the structure 100, e.g., to an upper surface of a dielectric layer. Alternatively, the RDL 104 can be formed using deposition and etching (reactive ion etching (RIE)) processes, but with less stringent design rules compared to the BEOL layer 102*a*.

Still referring to FIG. 1, the structure 100 further includes a vertically stacked transformer 120. In embodiments, the vertically stacked transformer 120 is composed of the BEOL layer 102*a* and BEOL layer 102*b* (as a secondary winding) and RDL 104 (as the primary winding with the BEOL layer 102*a*), or vice versa. In embodiments, the BEOL layers 102*a*, 102*b* are copper or aluminum layers formed using conventional CMOS processes. For example, the BEOL layers 102*a*, 102*b* can be formed using conventional additive or subtractive metallization processes, e.g., deposition, lithography and etching processes. The BEOL layers 102*b* can have the same or different dimensions and spacings as the BEOL layer 102*a*, depending on the particular design rules as described herein.

In embodiments, the BEOL layers 102*a*, 102*b* are vertically stacked and can be connected by one or multiple metal vias 106. Also, the BEOL layers 102*a*, 102*b* can be composed of one or more windings in different configurations. For example, the BEOL layers 102*a*, 102*b* can be spiral windings formed in any number of different shapes, including octagonal, square, rectangle, circular, hexagonal, etc., with a certain number of turns, e.g., three, five, six, seven, etc. with a certain predefined spacing therebetween as already described herein. In the embodiment shown, the BEOL layers 102*a*, 102*b* include three windings. Moreover, the stacked wirings of the BEOL layers 102*a*, 102*b* can be two or more separate structures on a same plane, in a symmetrical configuration as shown by reference numeral 112.

FIG. 2 shows a layout view of the vertically stacked inductor and transformer in accordance with aspects of the disclosure. More specifically, the structure 100' includes the vertically stacked inductor composed of the BEOL layer 102*a* and the upper RDL 104. As in the previous embodiment, the RDL 104 is shown as a single winding, although any appropriate number of windings for a specific design rule are contemplated. The RDL 104 can have the same pitch or different pitch than the underlying BEOL layer 102*a*, and can also have different dimensions, e.g., width, height and shape, than the BEOL layer 102*a* or any combinations thereof. As noted already herein, the design rules (i)-(ix) for the wiring layers (conductors) can be implemented with this and any of the embodiments described herein.

In embodiments, the RDL 104 can have a thickness of about 6 μm to 7 μm compared to the thickness of the BEOL layer 102*a* of about 3 μm to about 4 μm; although other dimensions are contemplated herein depending on the design parameters of the vertically stacked inductor. Also, as noted already herein, the RDL 104 can be a metal material, e.g., copper, manufactured in a number of inexpensive ways (compared to the BEOL layer 102*a*), with less stringent design rules compared to the BEOL layer 102*a*.

Still referring to FIG. 2, the structure 100' further includes a vertically stacked transformer composed of the BEOL layer 102*a* and BEOL layer 102*b* as a secondary winding, and RDL 104 with the BEOL layer 102*a* as the primary winding. However, depending on the amount of turns and hence inductance, the BEOL layer 102*a* and BEOL layer 102*b* can be the primary winding, and RDL 104 with the BEOL layer 102*a* can be the primary winding.

In embodiments, the BEOL layers 102*a*, 102*b* are copper or aluminum layers formed using conventional CMOS processes. In this implementation, the BEOL layers 102*a*, 102*b* are vertically stacked and can be connected by one or multiple vias 106, and can have dimensions and spacings as already described herein. Also, the BEOL layers 102*a*, 102*b* can be composed of one or more windings in different configurations, e.g., six windings (although other number of windings are also contemplated herein). The BEOL layers 102*a*, 102*b* can be spiral windings formed in any number of different shapes, including octagonal, square, rectangle, circular, hexagonal, etc. Moreover, the stacked wirings of the BEOL layers 102*a*, 102*b* can be two or more separate structures on a same plane, in a symmetrical configuration, with the RDL layer 104 stacked on top of the BEOL layers 102*a*, 102*b*. In this embodiments, $G_{max}$=0.78, K=0.68, N=10 and IL=1.06.

FIG. 3 shows a cross-sectional view of the vertically stacked inductor in accordance with aspects of the disclosure. More specifically, the vertically stacked inductor 100' includes the BEOL layer 102*a* and the upper RDL 104, with an intervening magnetic layer 114 (e.g., ferro magnetic material). The magnetic layer 114 can be about 2 μm to about 10 μm in thickness; although other dimensions are also contemplated herein.

In embodiments, the magnetic layer 114 can be an electrically floating plane about 2 to 5 microns above and below respective layers 102*a*, 104. In further embodiments, the magnetic layer 114 can be a patterned magnetic layer, unlike a solid plane of magnetic material. In embodiments, the patterned magnetic layer 114 can extend beyond an edge of the inductor by 0-20%; although other extended regions are also contemplated by the present disclosure. In embodiments, the magnetic layer 114 can be CoTaZr alloy used with CMOS processes; although other magnetic materials are also contemplated to be used herein. In preferred embodiments, the magnetic layer 114 should retain its properties up to about 400° C., and would have a permeability of about 870 and a ferromagnetic resonance of about 1.4 GHz. Moreover, the magnetic layer 114 should have $H_c$ of approximately 0.2 Oe and a resistivity of about 100 μΩ.

Still referring to FIG. 3, the BEOL layer 102*a* and the RDL 104 include a plurality of windings, e.g., six, although any appropriate number of windings for a specific design rule are contemplated by the present disclosure. The RDL 104 and the BEOL 102*a* can have the same pitch or different pitch, and can also have the same or different dimensions, e.g., width, height and shape, or any combinations thereof. As noted already herein, the design rules (i)-(ix) for the wiring layers (conductors) can be implemented with this and any of the embodiments described herein.

By way of illustrative example, the RDL 104 can have a thickness of about 6 μm to 7 μm compared to the thickness of the BEOL layer 102*a* of about 3 μm to about 4 μm; although other dimensions are contemplated herein depending on the design parameters of the vertically stacked inductor 110'. Also, as noted already herein, the RDL 104 can be a metal material, e.g., copper, manufactured in a number of inexpensive ways (compared to the BEOL layer 102*a*) as already noted herein, with less stringent design rules compared to the BEOL layer 102*a*.

On the other hand, the BEOL layer 102*a* is formed by CMOS processes. For example, as in each of the embodiments, a dielectric layer 116 can be deposited and patterned using conventional processes. For example, the dielectric layer 116 can be deposited using a conventional chemical vapor deposition (CVD) process. A resist is formed on the dielectric layer 116 and exposed to energy (light) to form a pattern (openings). An etching process, e.g., reactive ion etching (RIE) with appropriate chemistries, can then be performed to form shallow trenches in the dielectric layer 116 in the pattern of the windings. The resist can be removed using conventional stripants, e.g., oxygen ashing. A metal material, e.g., tungsten, copper or aluminum, etc., can be deposited within the openings to form the BEOL layer 102*a*. Any residual metal can be removed by a chemical mechanical polish (CMP). The metal layer 114 can be formed in a similar manner, such that no further explanation is required for one of ordinary skill in the art to understand the present disclosure.

FIG. 4 is a cross-section view of a vertically stacked inductor and transformer in accordance with aspects of the disclosure. In this embodiment, the vertically stacked transformer includes the inductor structure 110' of FIG. 3, e.g., coupled stacked serial inductor as the primary winding of the transformer. In addition, the transformer 120' includes the BEOL layer 102*a*, in addition to BEOL layers 102*b*, 102*n*. In embodiments, the BEOL layer 102*n* can be a plurality of layers, e.g., two or more layers connected by a via structure, having a thickness of about 0.4 μm to about 0.6 μm; whereas, the BEOL layers 102*a*, 102*b* can have a thickness of about 3.0 μm to about 4.0 μm. In embodiments, the secondary winding of the transformer 120' can include the BEOL layers 102*b*, 102*n*. The BEOL layers 102*a*, 102*b* can be formed using conventional CMOS processes as already described herein.

The method(s) as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A structure, comprising:

a first conductor composed of a redistribution line;

a second conductor composed of a back end of line wiring layer; and a third conductor composed of a back end of line wiring layer connected to the second conductor and magnetically coupled to the first conductor, wherein the first conductor and the second conductor are different from one another in width and thickness, and the back end of wiring layer comprises a first metal layer and a second metal layer, the first metal layer comprises the second conductor and a fourth conductor, the second metal layer comprises the third conductor and a fifth conductor, the second conductor is co-planar with the fourth conductor, and the third conductor is co-planar with the fifth conductor.

2. The structure of claim 1, wherein the second conductor and the third conductor are wound in a spiral configuration.

3. The structure of claim 2, wherein the first conductor is a single winding.

4. The structure of claim 2, wherein the first conductor and the second conductor are multiple windings, and wherein the first conductor and the second conductor differ from one another in pitch and shape.

5. The structure of claim 1, wherein the first conductor has a thickness of 6 μm to 7 μm and the second conductor has a thickness of 3 μm to 4 μm.

6. The structure of claim 1, wherein the first conductor forms a primary coil of the transformer and the second and third conductors form a secondary coil of the transformer.

7. The structure of claim 1, wherein the second and third conductors forms a primary coil of the transformer and the first conductor forms a secondary coil of the transformer.

8. The structure of claim 1, wherein the first conductor is a metal.

9. The structure of claim 8, wherein the second and third conductors are metal.

10. The structure of claim 1, wherein the second and third conductors are coupled by multiple metal vias.

11. The structure of claim 1, wherein the first conductor is on a top surface of the structure and above the back end of line wiring layer.

12. The structure of claim 11, wherein the first conductor is bonded to an upper surface of a dielectric layer.

13. The structure of claim 8, wherein the metal of the first conductor comprises copper.

14. The structure of claim 9, wherein the second conductor and the third conductor comprises aluminum.

15. The structure of claim 1, wherein the second conductor, the third conductor, the fourth conductor, and the fifth conductor are all connected to each other.

* * * * *